US008038061B2

(12) United States Patent
Kalech et al.

(10) Patent No.: US 8,038,061 B2
(45) Date of Patent: Oct. 18, 2011

(54) VOTING BY PEERS WITH LIMITED RESOURCES

(75) Inventors: Meir Kalech, Modiln (IL); Sarit Kraus, Givat Shmuel (IL); Gal A. Kaminka, Kfar-Saba (IL); Claudia V. Goldman-Shenhar, Mevasseret Zion (IL)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 599 days.

(21) Appl. No.: 11/905,481

(22) Filed: Oct. 1, 2007

(65) Prior Publication Data

US 2009/0084837 A1 Apr. 2, 2009

(51) Int. Cl.
*G07C 13/00* (2006.01)

(52) U.S. Cl. ..... 235/386; 235/51; 705/12

(58) Field of Classification Search ..... 705/12
See application file for complete search history.

(56) References Cited

U.S. PATENT DOCUMENTS

| | | | | |
|---|---|---|---|---|
| 7,533,813 | B2 * | 5/2009 | Knowles | 235/386 |
| 2003/0055719 | A1 * | 3/2003 | Faigle | 705/12 |
| 2003/0233274 | A1 * | 12/2003 | Urken et al. | 705/12 |
| 2005/0101307 | A1 * | 5/2005 | Brugge et al. | 455/414.1 |
| 2005/0171794 | A1 * | 8/2005 | Lubetzky | 705/1 |
| 2005/0188399 | A1 * | 8/2005 | Tischer | 725/34 |
| 2005/0284935 | A1 * | 12/2005 | Sinha | 235/386 |
| 2006/0171308 | A1 * | 8/2006 | Jung et al. | 370/229 |
| 2007/0058796 | A1 * | 3/2007 | Schmidt et al. | 379/202.01 |
| 2010/0114988 | A1 * | 5/2010 | Linn et al. | 707/805 |

OTHER PUBLICATIONS

Berry et al. "Multi-Criteria Evalution in User-Centric Distributed Scheduling Agents",In Proc. of the AAA1 2006 Spring Symposium on Distributed Plan and Schedule Management, 2006.

Chevalier de Borda "Range Voting.Org", rangevoting.org/RangeVoting.html.

Conitzer et al. "Communication Complexity of Common Voting Rules", Proceedings of the 6th ACM conference on Electronic commerce, pp. 78-87, 2005.

Konczak et al. "Voting Procedures With Incomplete Prefernces", Proc. of Multidisciplinary IJCAI'05 Workshop on Advances in Preference Handling, 2005.

Leedberg "Cotiro: A College Time and Room Scheduler Using Constraint Satisfaction", CS 730 Course at the University of New Hampshire, 2003.

Smith "Why Range Voting Is Better Than Borda Count Voting", www.math.temple.edu/~wds/homepage/rangeVborda, 2004.

Wallace et al. "Constraint based multi-agent meeting scheduling: Effects of agent heterogeneity on performance and privacy loss", Proceedings Third International Workshop on Distributed Constraint Reasoning: p. 176-182, 2002.

* cited by examiner

*Primary Examiner* — Thien M. Le
*Assistant Examiner* — Christle Marshall

(57) ABSTRACT

A method for voting by peers via mobile devices operating in a network on behalf of their owners, comprising iteratively sending by a plurality of peers votes for candidates to a peer and determining by the peer, according to the votes, at least one winner candidate.

29 Claims, 4 Drawing Sheets

VOTING BY PEERS WITH LIMITED RESOURCES

FIELD OF THE INVENTION

This invention, in some embodiments thereof, relates to agreeing on an object by peers. Some embodiments relate to a method for scheduling a meeting by cellular devices.

BACKGROUND OF THE INVENTION

Scheduling using constraints satisfaction is known in the art. For example, Pauline Berry, Melinda Gervasio, Bart Peintner, Tomas Uribe, Neil Yorke-Smith, Multi-Criteria Evaluation in User-Centric Distributed Scheduling Agents, Artificial Intelligence Center, SRI International, or Richard J Wallace and Eugene C. Freuder Cork, Constraint-based Multi-agent Meeting scheduling: effects of Agent Heterogeneity on Performance and Privacy Loss, Constraint Computation Center, or Gregory G. Leedberg, Cotiro: A College Time and Room Scheduler Using Constraints Satisfaction, Cornell University (http://leedberg.com/glsoft/cotiro/cotiro.pdf), the disclosures of which are incorporated herein by reference.

SUMMARY OF THE INVENTION

A broad aspect of some embodiments of the invention relates to voting by peers interacting in a network via mobile devices operating on behalf of their owners. The mobile devices comprise, optionally, cellular or wireless phones and/or handsets and/or portable devices—hereinafter phones or cellular phones (or telephones).

Cellular phones are frequently characterized by one or more of (a) limited resources, such as memory, energy and computing power, (b) limited communications bandwidth, and (c) communications cost, for either or both of the sending and receiving parties. Another typical characteristic of cellular phones is the dynamics of the system as units may randomly connect or disconnect.

Voting, contrary to mutual agreement, may result in a winner that is not favored by one or more of the voters, or, more generally, in a less than optimal solution or in a solution that is not as good as could have been achieved using constraint satisfaction. Yet, optionally, the winner is a feasible one and, optionally, the voters agree to the winner.

An aspect of some exemplary embodiments of the invention relates to voting for an object by phones while avoiding excessive load on phones.

In exemplary embodiments of the invention, the coordination of the voting is carried out by a peer, an initiator peer ('initiator'). The peers send one or more candidate objects with the corresponding preferences (voting) of the peers about the candidates responsive to requests by the initiator.

In exemplary embodiments of the invention, the initiator requests the votes from the peers iteratively. Optionally, a peer provides in response to an iterated request a sub-set of its votes, such that the voting is performed incrementally.

In exemplary embodiments of the invention, the initiator determines a winner based on incomplete voting, optionally in order to save resources of the phones. Optionally or additionally, the determination of a winner is based on estimates of the preference of peers with respect to candidates they did not provide (but provided by other peers). Optionally, the winner is not the most preferred candidate but, optionally, a viable one. Optionally, as more votes are incrementally provided by the peers responsive to iterated requests by the initiator, enlarging the scale of the voting, a more probable winner may be determined by the initiator.

In exemplary embodiments of the invention, the iterated incremental voting allows phones that intermittently join and leave the network to participate in the voting, at least partially. Optionally, a peer may vote and leave the network, or optionally a peer may join the network during the voting process and participate in the voting, yet the voting of the intermittent peers, though possibly partial, is taken into account for electing a winner. Thus, optionally, the voting is enabled in a dynamic system such as cellular phones.

In exemplary embodiments of the invention, the incremental voting divides the load on the peers, and, optionally, reduces the memory requirements of the initiator.

In exemplary embodiments of the invention, the voting method is configured to further reduce the load on the phones in terms such as bandwidth utilization, or energy consumption, or communication costs.

In exemplary embodiments of the invention, phones resources are saved when peers provide the initiator with a group of candidates and a common preference (voting) in the same transmission, rather than by separate pairs of candidate-vote. Optionally, the common vote is not the favorable preference for each of the candidates.

In exemplary embodiments of the invention, phones resources are saved when the initiator iteratively collects incremental votes within a limited number of iterations and opts for the most probable ones. Subsequently, optionally, the initiator iteratively requests the opted candidates from the peers. Thus, by limiting the number of iterations and avoiding transmissions of candidates with probably low preference the load on the phones is reduced.

In exemplary embodiments of the invention, load on the phones could be further saved by combining the methods described above.

In exemplary embodiments of the invention, methods that save resources of the phones by limiting the scale of the voting result with a less favorable winner relative to methods based on a larger or full scale voting. Optionally, the winner is a feasible one and the voters accept it.

In an exemplary embodiment of the invention, the incremental voting obtained by iterations allows to pre-set, or determine during the voting, a tradeoff (compromise) between the confidence of the elected winner and the load on the phones in terms such as bandwidth, memory or battery or costs.

In exemplary embodiments of the invention, the tradeoff is determined by operational load factors. For example, a maximal load on the initiator is based by factors such as memory capacity or bandwidth limitations or battery reserve, and a maximal load on peers is based on factors such as cost of transmission or battery reserve or bandwidth limitations.

In exemplary embodiments of the invention, the tradeoff is according to load settings entered or effected by a peer owner. Optionally, the tradeoff is according to operational rules which, optionally, take into account the load on phone resources.

An aspect of some exemplary embodiments of the invention relates to voting for a coordinated object, or event, or operation, or a transaction, or a similar entity.

In exemplary embodiments of the invention, coordinated comprises synchronized, or shared or concurring.

For example, voting for a meeting time, or voting for a meeting place, or voting for a transportation method, or voting for a direction.

In exemplary embodiments of the invention, the voting implies that the participants consent to the winning entity, though it is not necessarily a mutually preferred one. For example, a voted meeting time is scheduled, or a voted a meeting place is set, or a voted transportation method is reserved which are not convenient to one or more of the participants.

In exemplary embodiments of the invention, the voting, at least partially, is carried out by phones operating on behalf of their owners. Optionally, the voting is performed by methods that avoid excessive load on phones.

In the specifications and claims, unless otherwise specified, the term 'winner' denotes a candidate that, based on the votes and/or estimation, is determined as a most favorable, wherein a winner may denotes a plurality of winners.

It is provided in accordance with exemplary embodiments of the invention a method for voting by peers via mobile devices operating in a network on behalf of their owners, comprising:

a) iteratively sending by a plurality of peers votes for candidates to a peer; and b) determining by the peer, according to the votes, at least one winner candidate.

In exemplary embodiments of the invention, sending is responsive to requests by the peer. Optionally, the peer defines the candidates.

Optionally, sending comprises sending a part of the votes of the plurality of peers.

In exemplary embodiments of the invention, determining comprises determining based on partial votes. Optionally, determining comprises determining according to estimation of votes. Optionally, determining comprises determining according to modified votes. Optionally, the votes are modified according to a privilege of a peer.

In exemplary embodiments of the invention, a plurality of peers comprises peers that join the network during the voting.

In exemplary embodiments of the invention, a plurality of peers comprises peers that leave the network during the voting.

In exemplary embodiments of the invention, sending votes comprises sending a group of candidates with a common vote.

In exemplary embodiments of the invention, sending votes comprises sending votes of candidates according to candidates already sent.

In exemplary embodiments of the invention, the number of iterations is limited.

In exemplary embodiments of the invention, determining is according to a compromise between a confidence of a winner and usage of the resources of the devices. Optionally, resources comprise at least one of bandwidth, energy, memory or operation costs.

In exemplary embodiments of the invention, the mobile devices comprise wireless devices. Optionally, the mobile devices comprise cellular devices. Optionally, the devices operate on behalf of owner, at least partially, by computerized agents.

There is further provided in accordance with exemplary embodiments of the invention a method for voting by peers via mobile devices operating in a network on behalf of their owners, comprising:

(a) providing peers with phones operating on behalf of the peers; and (b) voting by the peers for a winner with a confidence equal or less than that of constraints satisfaction.

In exemplary embodiments of the invention, the plurality of peers comprises peers that join or leave the network during the voting.

In exemplary embodiments of the invention, the voting is for a meeting time.

There is also provided in accordance with exemplary embodiments of the invention a system comprising computerized mobile devices configured to perform any of the methods described above.

In exemplary embodiments of the invention, the candidates comprise discrete objects. Optionally, the candidates comprise ranges within an extent of a continuous entity. Optionally, the candidates comprise at least one of meeting times, or meeting locations, or apparatus, or articles or agendas or positions or persons.

BRIEF DESCRIPTION OF THE DRAWINGS

Non-limiting examples of embodiments of the present invention are described with reference to figures listed below. In the drawings which follow, identical and/or equivalent and/or similar structures, elements, or parts that appear in more than one drawing are generally labeled with the same numeral in the drawings in which they appear. Dimensions of components and features shown in the figures are chosen for convenience and clarity of presentation and are not necessarily shown to scale.

DETAILED DESCRIPTION OF EMBODIMENTS OF THE INVENTION

The non-limiting headings that follow are intended for convenience only.

Cellular Telephones (and Other Devices)

Figure 3:
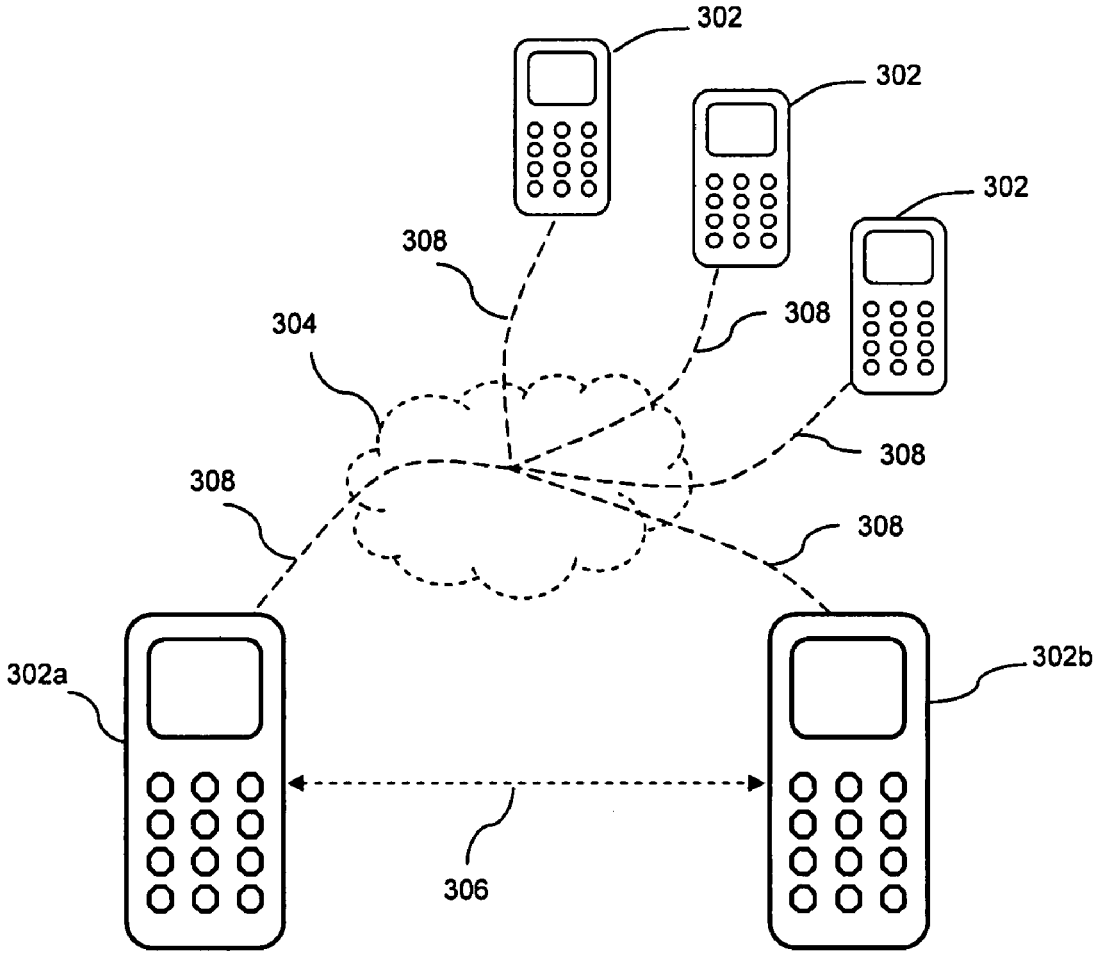
FIG. 3 schematically illustrates a peer-to-peer network comprising a group of connected peers represented by a plurality of cellular phones in a network, in accordance with an exemplary embodiment of the invention.

FIG. 3 schematically illustrates a peer-to-peer network comprising a plurality of connected peers represented by a plurality of cellular phones 302 in a cellular network 304, in accordance with an exemplary embodiment of the invention.

Phones 302 are connected by communications links 308 to the cellular system 304. A virtual peer-to-peer connection between phones, e.g. between phones 302*a* and 302*b* as illustrated in arrow-line 306, may be established via phone numbers in the phones directories, In exemplary embodiments of the invention, phones 302 are owned by persons, wherein phones 302 represent their owners and operate on the owner behalf.

In exemplary embodiments of the invention, other cellular devices are used such as PDA (personal data assistant) or other handsets or laptop computers with cellular adapter, or any equipment with a cellular or wireless component for cellular or wireless communication. Optionally other portable devices over wireless network are used. Optionally, devices with at least some of the characteristics of cellular phones (e.g. battery, limited resources) are of particular, though non-limiting, interest.

In exemplary embodiments of the invention, peers may be represented by devices such as conventional computers and connected by wires to the network, for example, via a gateway.

In exemplary embodiments of the invention the connection and data transfer between peers is carried out by techniques such as TCP/IP, Bluetooth, SMS, MMS, or other methods for transferring data between cellular and/or wireless devices.

In exemplary embodiments of the invention, a device operates on behalf of its owner, at least partially, by a computerized agent, as described later on.

Voted Objects and Winners

In exemplary embodiments of the invention, a winner object is selected from a plurality of candidate objects. Optionally, the objects are discrete, for example, persons, apparatus, articles, locations or events.

In exemplary embodiments of the invention, the objects are predefined. Optionally, the objects are suggested and/or dictated by the initiator. Optionally, objects are suggested by one or more peers. For example, the initiator may suggest 3 locations (such as restaurants) for a meeting, and optionally, a peer may suggest another location (e.g. a café) nearby his or her house. Or as another example, for a group of peers that are to travel together the initiator suggests that either a car or bus or train is used, or, optionally a peer suggests a plane. Or as another example, peers may vote for candidates for a position or role, such as administrative or executive job, e.g. chairman of a committee or conference. Or as another example, having a plurality of agendas for a meeting, participant peers may vote for the priority agenda for the meeting. Or as another example, a plurality of positions is open and peers vote for a preferred position.

In exemplary embodiments of the invention, the number of candidates is closed. Optionally, candidates are added during the voting.

In exemplary embodiments of the invention, the objects are divisions, or ranges, within an extent of a continuous entity, for example, time ranges (slots) in a calendar, or locations within a geographical zone, or a direction range (sector).

In exemplary embodiments of the invention, the extent of the continuous entity is predefined or implied (e.g. direction within a circle or the current day for a meeting). Optionally, the extent (e.g. date or dates range) is suggested and/or dictated by the initiator. Optionally, the extent is suggested, at least partially, by one or more peers.

In exemplary embodiments of the invention, a range within an extent is suggested and/or dictated by the initiator, for example, a time slot (such as 1 hour) within the extent of a calendar. Optionally, the range is suggested by one or more peers.

In exemplary embodiments of the invention, a winner in a vote may not be the one preferred by all the voters, yet it may be a viable one to which all the peers consent. For example, for scheduling a meeting the peers voted on a 1 hour slot in a date, and the winning candidate is from one 1 PM to 2 PM, which may compel one or more candidates to postpone a planned lunch.

In exemplary embodiments of the invention, a plurality of winners is elected. For example, when a voting for a 3 members committee, 3 candidates are elected. As another example, having a plurality of agendas for a meeting, participant peers may vote on the order of agendas for the meeting (e.g. plurality of winners, in decreasing importance). As another example, designers vote on 2 colors within a continuous range (e.g. hue range), so that 2 winning colors are elected as winners.

In exemplary embodiments of the invention, one or more voting peers may not accept the vote, for example, a peer cannot join the voted meeting time since he or she is out of town or the meeting location is too far. Optionally, when a peer does not accept a winner, or is dissatisfied with a winner, the peer notifies the initiator, and optionally other peers. Optionally, the initiator performs more iterations (see later) to collect more votes, and/or re-starts the voting, and/or postpone the voting, and/or changes it. Optionally, the initiator decides on the response based on the satisfaction (or dissatisfaction) of a plurality of peers. Optionally, the response may consume more resources of the peer phones, yet a more acceptable winner may be elected, such that a tradeoff is determined between acceptability of a winner and load on the phones.

In exemplary embodiments of the invention, the candidates are identified by preset and/or suggested and/or agreed codes. Optionally, the initiator sends the suggested candidates and respective codes, so that in a subsequent or later voting the peers may used codes and save resources in transmission. Optionally, the initiator sends codes that represent voting parameters such as optional ranges of candidates, for example, meeting dates or days from now.

In exemplary embodiments of the invention, the initiator notifies the peers on the range of votes (preferences). Optionally, the voting preferences are expressed as codes. Optionally, the initiator notifies the peers on the votes codes.

Voting with Partial Information

Voting for a preferred candidate in a scheme such as proposed by Jean-Charles Chevalier de Borda ('Borda') in 1770 is known for centuries. In Borda the votes are based on the number of candidates and the difference in vote between a candidate and the next favorable one is typically 1. On the other hand, methods where a more significant difference between candidates can be expressed were proposed, such as range voting, e.g. www.math.temple.edu/~wds/homepage/rangeVborda or rangevoting.org/RangeVoting.html, the disclosures of which are incorporated herein by reference.

Deciding on the most favorable candidate according to preferences of voters requires that each voter supplies the full set of candidates, at least in a worst case, as proved in V. Conitzer and T. Sandholm, *Communication complexity of common voting rules, EC '05: Proceedings of the 6th ACM conference on Electronic commerce, pages* 78-87, 2005, the disclosure of which is incorporated herein by reference.

In exemplary embodiments of the invention, however, voting by all the votes of all the peers is impractical for phones, due to the limited resources such as bandwidth, memory or battery capacity and, optionally, also to costs.

On the other hand, it was shown in K Konczak and J Lang, *Voting procedures with incomplete preferences, Proc. of Multidisciplinary IJCAI '05 Workshop on Advances in Preference Handling, Edinburgh, Scotland,* 2005, incorporated herein by reference, that in a non-worst case, a favorable candidate, though possibly not the favorite one, can be decided based on partial voting, wherein the partial voting may be incrementally extended to enable a determination of a more probable candidate.

Still, in some cases, in order to achieve trustworthy estimations of the preference of voters which did not provide at least some of their votes necessitate a number of voting iterations which may be too large for the phone resources or costs.

In exemplary embodiments of the invention, in order to reduce the number of iterations, reducing the load on the phones, the iterated incremental voting is modified. Optionally, the modified method enables to elect a favorable candidate based on a partial voting though, possibly, not the most favorite one is elected.

In the following discussion, unless otherwise specified, and in accordance with exemplary embodiments of the invention, an initiator peer ('initiator'), optionally via a phone 302, iteratively requests one or more peers for one or more candidates, wherein the candidates are provided to the initiator by each peer in a decreasing preference (vote), starting with the most favorable candidate.

Figure 4:
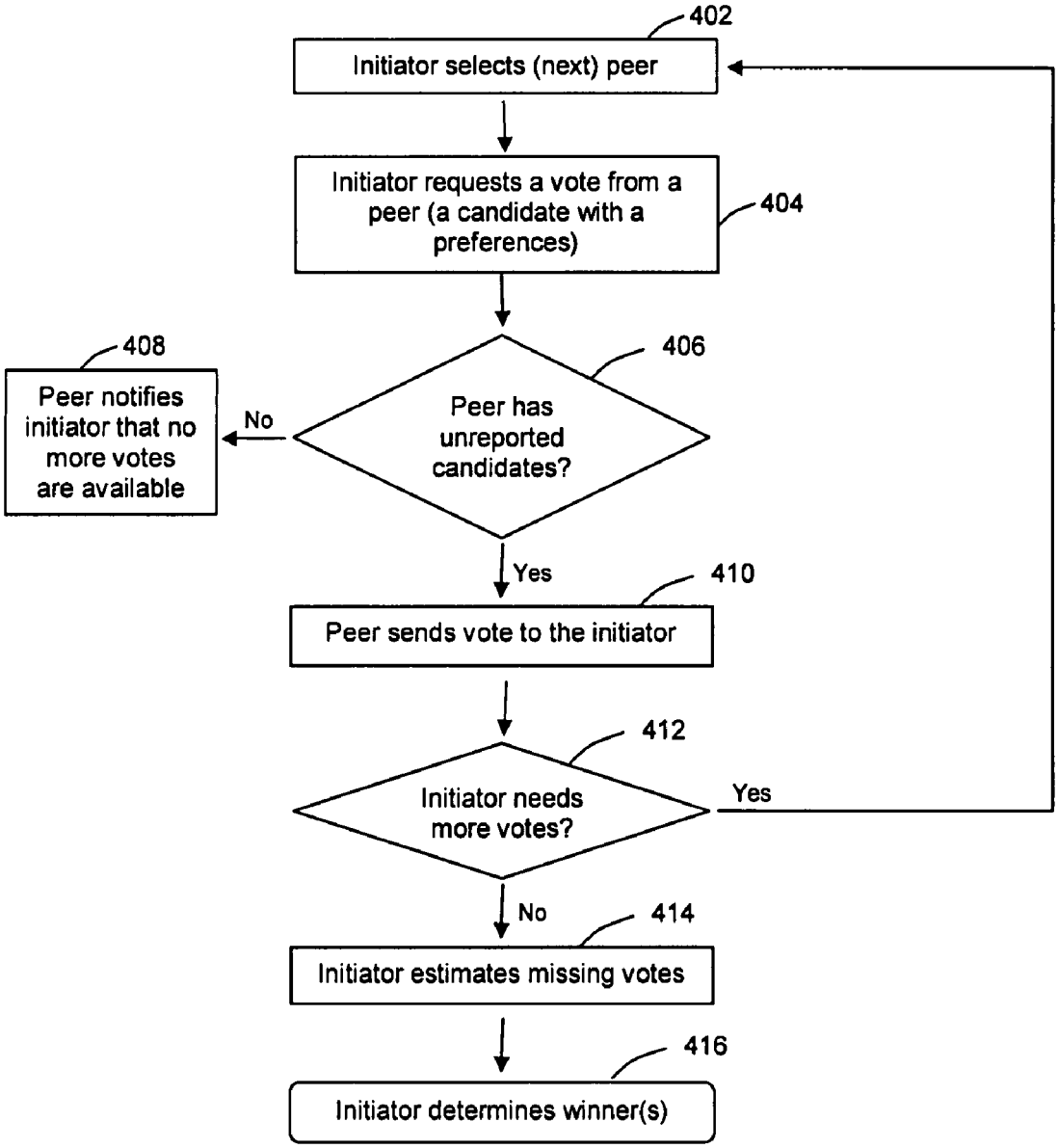
FIG. 4 is a flowchart outlining a schematic sequence of operations for determining a winner candidate, in accordance with exemplary embodiments of the invention.

FIG. 4 is a flowchart outlining a schematic sequence of operations for determining a winner candidate, in accordance with exemplary embodiments of the invention.

In exemplary embodiments of the invention, the initiator selects a peer phone 302 (402) and requests a vote (404). If the peer has already reported all its votes, or, optionally, peer phone 302 does not participate in the voting (406), peer phone 302 notifies the initiator to this effect (408). Otherwise, peer phone 302 sends the vote (candidate and corresponding preference) to the initiator (410).

In exemplary embodiments of the invention, the initiator analyzes if there are sufficient votes in order to determine a winner (412). Optionally, the analysis is based on a determination of the loads on the peers and/or the initiator phones 302. Optionally or alternatively, the analysis is based on an estimation of the loads on the peers and/or the initiator phones 302. Optionally, a tradeoff between the loads on phones 302 and the confidence of a winner is analyzed to determine if there are sufficient votes in order to determine a winner.

In exemplary embodiments of the invention, if there are not enough votes, the initiator selects another peer (402), and the sequence of blocks (402) through (412) is iterated. Otherwise, the initiator optionally estimates the votes (preferences) of peers with respect to candidates they did not provide (but, optionally, provided by other peers) (414). Optionally, the estimation is based on the preferences of candidates already supplied by a peer, taking into account that the votes were sent in an order of preferences, such that a peer does not have potential candidates with higher preferences than already supplied to the initiator by the peer. Optionally or alternatively, the estimation is based on the likelihood of lowest and/or highest preferences of potential candidates of a peer. Optionally, the estimation is based on a statistics of the likelihood of potential candidates, such as average between maximal and minimal likelihoods.

An example of determining vote estimation is given in the following discussion with respect to FIG. 1 later on.

In exemplary embodiments of the invention, based on the votes sent by the peers, and optionally, the estimation of potential preferences of peers, the initiator determines a winner candidate (416). Optionally, a candidate is elected according to the maximal score of votes. Optionally, a candidate is elected according to the maximal score of actual and estimated votes.

Optionally or alternatively, a plurality of winners is determined, optionally up to maximal number. Optionally, the plurality of winners is determined according to the maximal scores of votes, or optionally, according to the maximal scores of votes and estimated votes.

An example of determining a winner is given in the discussion with respect to FIG. 1 and FIG. 2 later on.

In exemplary embodiments of the invention, when peer phone 302 joins network 304, it notifies the initiator and, subsequently, the initiator includes the newly joined phone 302 in the voting (402). Optionally, a peer phone joins network 304 during the voting process.

In exemplary embodiments of the invention, if a peer phone 302 leaves network 304 during voting, or optionally declines to participate in the voting, the initiator skips peer phone 302 in selection of peers (402). Optionally, a missing or declining phone 302 is determined by an absence of response within a time out period. Optionally, the time out period is preset in the initiator and/or is determined by the initiator according to the performance of past or the current voting, for example, based on the response time of other peer phones 302.

In exemplary embodiments of the invention, as peer phones 302 intermittently leave and join network 304, the voting process is not disrupted and, optionally due to the incremental nature of the voting, the voting process can be carried out in a dynamic system such as cellular phones.

In exemplary embodiments of the invention, the initiator selects peers for voting so that each pear receives, at least approximately, an even opportunity for voting. Optionally, the initiator randomizes, at least partially, the peer selection. Optionally, the initiator gives privileged peers (see later) more opportunities for voting relative to other peers.

In exemplary embodiments of the invention, the initiator requests votes from peers that belong to a group as described later on.

In exemplary embodiments of the invention, if the initiator is participating in the voting, the initiator takes into account its own votes when it determines a winner.

In exemplary embodiments of the invention, the initiator modifies the votes (preference), for example, by weights. Optionally, the modification is according to the privilege level of a peer, as discussed later on. Optionally or alternatively, the initiator modifies the preferences such that the preferences conform to a common scale.

In the following discussions, without limiting the generality, and unless otherwise specified, a range voting is assumed. Namely, candidates are assigned preferences within a scale of ranges, e.g. 1 to 10, independent of the number of the candidates.

Voting by Groups

In exemplary embodiments of the invention, the method as described above is modified in order to save load on the participating peer phones 302.

In exemplary embodiments of the invention, instead of each peer providing a candidate with a corresponding preference (vote) in a transmission, a peer provides a group of candidates with a common preference in a transmission. In this manner the transmission capacity and/or time is reduced relative to sending each vote separately, reducing load on the phone and optionally reducing costs.

In exemplary embodiments of the invention, the common vote is not the true preference for each of the candidates, which may effect a determination of less preferred winner relative to voting each candidate with the corresponding true preference.

In exemplary embodiments of the invention, when the initiator receives the group of votes, the initiator divides the group into its constituent candidates, each with a corresponding common preference.

For example, when the candidates comprise a one hour period for a meeting, a peer may send the initiator 3 iterated messages such as: 11 Sep. 2007 13:00-14:00/10; 11 Sep. 2007 14:00-15:00/7; 11 Sep. 2007 15:00-16:00/5 (where/p denotes the preference, 10 being the highest). However, in order to reduce the load on the phones, only one message is sent, such as: 11 Sep. 2007 13:00-16:00/7. Consequently, the initiator resolves the 13:00-16:00 range into 3 one hour slots, namely, 11 Sep. 2007 13:00-14:00/7; 11 Sep. 2007 14:00-15:

00/7; 11 Sep. 2007 15:00-16:00/7. Yet, the 13:00-15:00 slot is assigned a lower preference then the true preference (7 instead of 10), and the 15:00-16:00 slot is assigned a higher preference (7 instead of 5).

In exemplary embodiments of the invention, the incorrect preferences can mislead the initiator to schedule a meeting at a less favorable time slot with respect to the preferences of the peers, resulting in a tradeoff between the load saving and the confidence of the winner.

Figure 1:
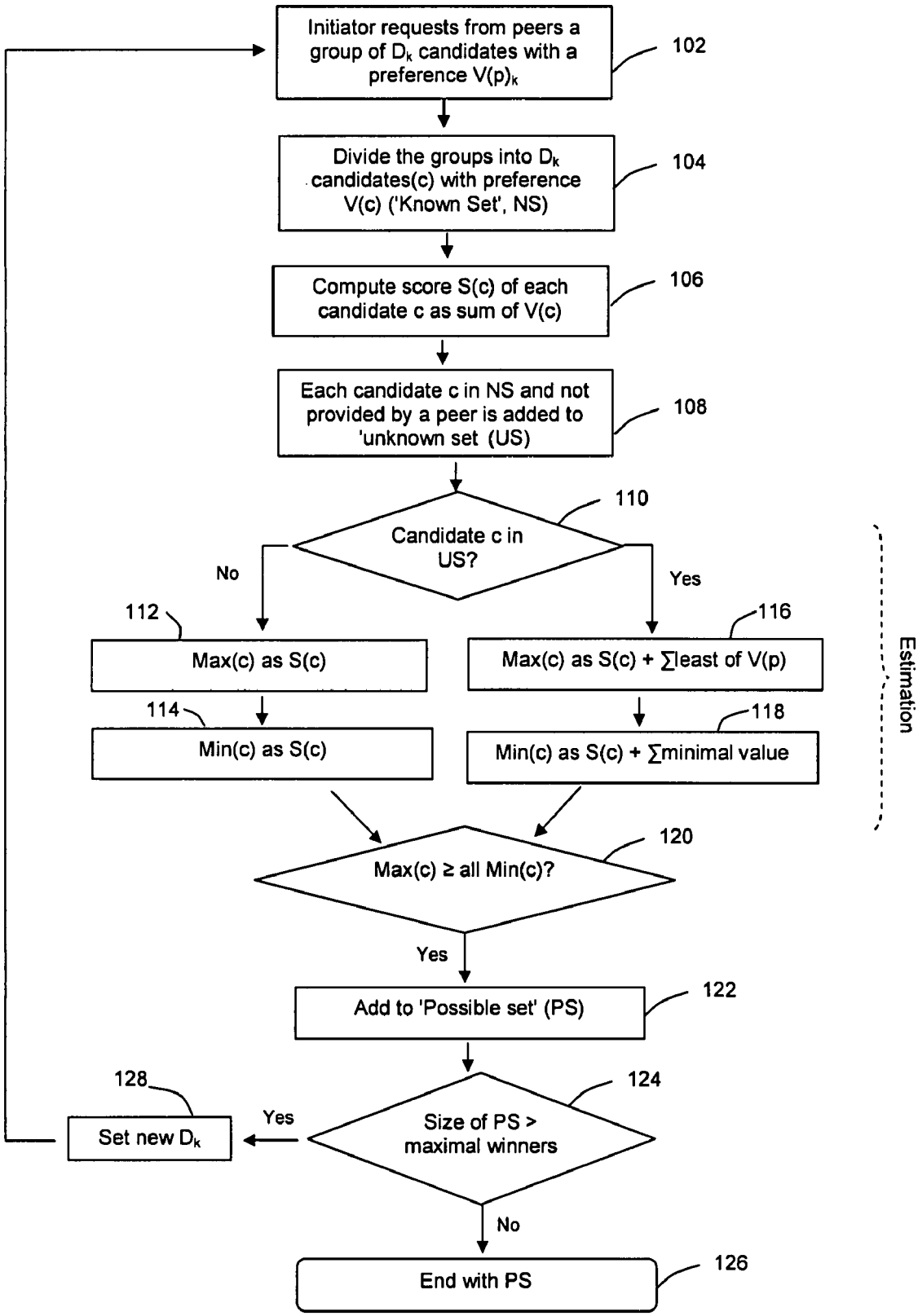
FIG. 1 is a flowchart outlining a sequence of operations for determining a winner based on voting by groups of candidates with a common preference, in accordance with exemplary embodiments of the invention.

FIG. 1 is a flowchart outlining a sequence of operations for determining a winner based on voting by groups of candidates with a common preference, in accordance with exemplary embodiments of the invention.

The operation outline of FIG. 1 is accompanied partially with an example, wherein:

(a) the range of preference values (voting) for a candidate is between 1 (least preferred) and 10 (most preferred);

(b) in the first iteration (k=0) the group comprises 2 candidates ($D_0$);

(c) the group of a peer p is assigned a common vote $V(p)_k$;

(d) the number of voting peers, excluding the initiator, is 3; and (e) the maximal number of winners MW is 1.

Initially, in the first iteration (k=0) the initiator requests from other peers to provide a group of $D_0$ candidates with a common vote $V(p)_0$ (102).

For example:

peer 1 p1 sends a group of candidates c1 and c2 with a vote value of 9;

peer 1 p2 sends a group of candidates c1 and c2 with a vote value of 7; peer 1 p1 sends a group of candidates c2 and c3 with a vote value of 5.

The initiator divides the group to separate candidates with the corresponding common vote (104), which comprises the 'Known set' (NS), as summarized in the table below.

TABLE 1

| | c1 | c2 | c3 |
|---|---|---|---|
| p1 | 9 | 9 | ? |
| p2 | 7 | 7 | ? |
| p3 | ? | 5 | 5 |

The score S(c) of each candidate c is computed as the sum of the votes V(c) of each candidate c (106), as summarized in the table below:

TABLE 2

| c1 | c2 | c3 |
|---|---|---|
| 16 | 21 | 5 |

As can be seen, the peers did not provide all the candidates and there are candidates with missing votes. The set of peers in the Known set NS that were not provided by other peers are added to an 'Unknown set' (US) (108). For example, c1 of p3, and c3 of p1 and p2, as indicated by '?' in Table 1.

According to the known votes in NS, maximal and minimal votes are estimated for each missing candidate c in US, as follows:

Since each peers send votes in decreasing preference order, a peer may still have potential un-voted candidates with preferences that are not larger than the preference of candidates that the peer has already sent. For example, according to Table 1, peer p1 cannot send a vote for candidate c1 larger than 5, and similarly, p1 and p2 cannot send a vote for c3 larger than 9 and 7, respectively.

For each candidate c in the Unknown set US the maximal estimated score Max(c) is set to the score S(c) with the addition of the sum of the minimal vote V(c) of each peer (116). Therefore, the maximal estimation Max(c1) is 9+7+5=21 and Max(c3) is (due to the common vote of group $D_0$) is also 9+7+5=21.

For each candidate c in the Unknown set US the minimal estimated score Min(c) is set the score S(c) with the addition of the sum of the minimal possible vote (118). For example, as the minimal vote is 1, according to Table 1 the minimal score Min(c1) for c1 is 9+7+1=17, and Max(c3) is 1+1+5=7.

For candidates not in the Unknown set (US), that is, candidates in the Known set NS, all the votes are known so the minimal and maximal scores equal to the score V(c) (112 and 114), so according to Table 1 the Max(c2) and Min(c2) are 9+7+5=21.

The maximal and minimal scores are summarized in the table below.

TABLE 3

| | c1 | c2 | c3 |
|---|---|---|---|
| Max | 21 | 21 | 21 |
| Min | 17 | 21 | 7 |

The maximal and minimal scores are evaluated to select candidates with maximal score that is larger or equal to the minimal scores of any of the other candidates (120) and adding them to a set of Possible set (PS) (122), eliminating the rest as improbable candidates. For example, according to table 1, PS comprises c1, c2 and c3.

In exemplary embodiments of the invention, it is desired to focus on a small set of possible winners since with too many winners the vote is not conclusive. Therefore, the Possible set (PS) is checked against the maximal allowed number of winners MW (124), and if the set is equal or smaller than MW, the vote is over (126). Otherwise, another iteration is started (k=1) and the initiator requests a group of $D_1$ candidates. Optionally, $D_1$ equals $D_0$, or, optionally, $D_1$ is larger or smaller than $D_0$.

In the example, MW is 1 and PS comprises 3 candidates, larger than MW, so another iteration commences, optionally with different group size $D_k$.

For example, in the next iteration (k=1), $D_1$ is 1 and p1 sends c3 with a vote of 4, p3 sends c1 with a vote of 4 and p2 does not send any vote (e.g. p2 is offline), as summarized in the table below.

TABLE 4

| | c1 | c2 | c3 |
|---|---|---|---|
| p1 | 9 | 9 | 4 |
| p2 | 7 | 7 | ? |
| p3 | 1 | 5 | 5 |

The maximal and minimal scores are summarized in the table below.

TABLE 5

| | c1 | c2 | c3 |
|---|---|---|---|
| Max | 17 | 21 | 16 |
| Min | 17 | 21 | 10 |

In the second iteration (k=1), the Possible set PS comprises only candidate c1, which is equal to MW, and c2 is the winner.

In exemplary embodiments of the invention, if a possible set of winners smaller than or equal to the maximal winners MW is not found within a certain number of iterations, the voting fails. Optionally or alternatively, when a vote fails, the initiator selects one or more winners (up to MW). Optionally, the selection is according to a maximal score, or minimal score, or average score, or another statistics of a candidate in the possible set PS, or a combination thereof. Optionally, the selection is random, at least partially.

In exemplary embodiments of the invention, rather than using voting by a range of preferences, other voting schemes may be used, such as Borda, where a preference is assigned based on the number of candidates. For example, when the number of candidates is m, the most preferred candidate is assigned a value of m, secondly preferred candidate is assigned a value of m−1 and least preferred candidate a value of 1.

The setting of the parameters of the method described above is discussed later on.

In some exemplary embodiments of the invention, optionally according to FIG. 4, instead of providing candidates in groups with a common preference, candidates may be provided separately with a true preference. In such a case, optionally, the probability of focusing on the favorite candidate, or a more probable candidate, is increased on the expense of increased load on the phones. For example, according to FIG. 1, in block 102 the initiator would request candidates with their corresponding true votes, and block 104 is would be eliminated.

Early Elimination of Candidates

In exemplary embodiments of the invention, the method as described with respect to FIG. 4 is modified in order to save load on the participating peer phones 302.

In exemplary embodiments of the invention, peers incrementally provide their votes only during a limited number of iterations, and a group of peers are selected as possible winners. Subsequently, the initiator requests candidates in the selected winners group only. Optionally, load on the phones is reduced due to (a) the limited number of iterations, and (b) sending only candidates in the selected group, avoiding transmission of (possibly) irrelevant candidates.

Figure 2:
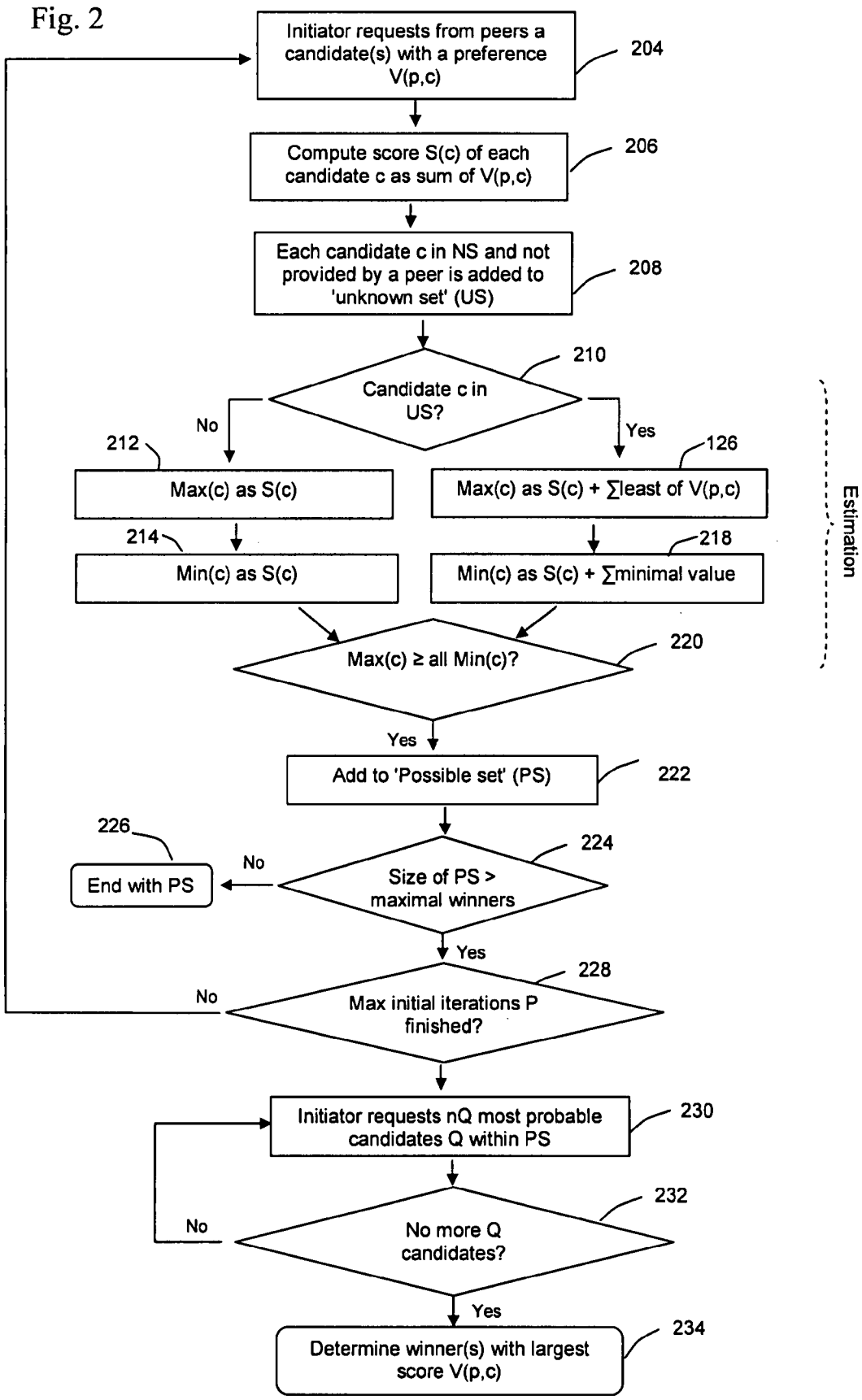
FIG. 2 is a flowchart outlining a sequence of operations for determining a winner based on early elimination of candidates, in accordance with exemplary embodiments of the invention.

FIG. 2 is a flowchart outlining a sequence of operations for determining a winner based on early elimination of candidates, in accordance with exemplary embodiments of the invention.

The operation outline of FIG. 2 is accompanied partially with an example, wherein:

(a) the range of preference values (voting) for a candidate is between 1 (least preferred) and 10 (most preferred);

(b) the number of initial iterations limit P is 1;

(c) each candidate c from a peer p is assigned a vote V(p,c);

(d) the number of peers, excluding the initiator, is 3;

(d) the number nQ of most probable peers Q selected after initial iterations is 2; and (e) the maximal winners MW is 1.

Initially, in the first iteration the initiator requests from other peers to provide candidates with votes V(p,c) (204).

For example:

peer 1 p1 sends a candidate c1 with a vote value of 10;

peer 1 p2 sends a candidates c2 with a vote value of 10;

peer 1 p3 sends a candidate c3 with a vote value of 9.

The information after the iteration is summarized in the table below.

TABLE 6

| | c1 | c2 | c3 |
|---|---|---|---|
| p1 | 10 | ? | ? |
| p2 | ? | 10 | ? |
| p3 | ? | ? | 9 |

The scores, as well as the estimated Max(c) and Min(c) are determined in blocks (206) through (226) of FIG. 2 as described above for blocks (106) through (126) of FIG. 1, respectively.

For example, after the first iteration the estimated Max(c) and Min(c) are summarized in the table below.

TABLE 7

| | c1 | c2 | c3 |
|---|---|---|---|
| Max | 29 | 29 | 29 |
| Min | 12 | 12 | 11 |

If winners are found during the initial iterations then the voting is done (226). If no winners were found during the initial iterations, the count of iterations is checked if it has reached the limit P (228). If the limit is not reached yet, the initiator requests more votes and the cycle repeats (204). Otherwise, the initiator selects the most probable nQ candidates Q in the Known set NS.

In exemplary embodiments of the invention, the most probable candidates Q are selected according to the maximal scores within the minimal estimations Min(c), as a worst case. Optionally, other methods are used to select the Q elements, for example, according to the Max(c), or average of Max(c) and Min(c), or another statistics. Optionally, in case the values are the same, another iteration is performed, or nQ candidates are selected arbitrarily, e.g. randomly.

Subsequently the initiator requests the Q candidates from the peers that did not vote for these candidates yet (230). The request for the Q candidates is repeated (232) until all the Q candidates are provided to the initiator. For example, the maximal number of the initial iterations P is 1, so the initial iterations are over. As nQ is 2, the 2 candidates with maximal Min(c), namely, c1 and c2 constitute the most probable candidates. Therefore, the initiator request c1 and c2 from the peers that did not provide their votes for these candidates.

For example, the peers provide the remaining candidates c1 and c2 as:

p1 votes 7 for c2;

p2 votes 8 for c1; and p3 votes 2 for c1 and 5 for c2.

The state is summarized in the table below:

TABLE 8

| | c1 | c2 | c3 |
|---|---|---|---|
| p1 | 10 | 7 | ? |
| p2 | 8 | 10 | ? |
| p3 | 2 | 5 | 9 |

Once all the Q candidates are provided, the initiator selects the winner according to the score S(c) of the candidates (234).

Optionally, one winner with the highest score is selected. Optionally or alternatively, according to the scores, maximal winners MW are selected, or winners up to MW are selected.

For example, the score of the candidates after all c1 and c2 were provided is summarized in the table below.

TABLE 9

| c1 | c2 |
|---|---|
| 20 | 22 |

Therefore, as MW is 1, c2 is selected as the winner (maximal of the minimum scores).

In exemplary embodiments of the invention, the number of iterations and transmissions is limited, reducing the load on the phones, yet it is possible that the favorite candidates, or even just more preferred candidates, are overlooked. However, in exemplary embodiments of the invention, a winner elected according to this method is viable one, while resources of the phones are saved.

For example, according to the previous example, it is possible that the votes of p1 and p2 for c3 are 9, which is the favorite candidate, so that if more iterations P were allowed the scores could be as in the following table:

TABLE 10

| | c1 | c2 | c3 |
|---|---|---|---|
| p1 | 10 | 7 | 9 |
| p2 | 8 | 10 | 9 |
| p3 | 2 | 5 | 9 |

According to Table 10, the scores S(c) are as in the following table:

TABLE 11

| | c1 | c2 | c3 |
|---|---|---|---|
| Max | 20 | 22 | 29 |

Therefore, according to Table 11, the score S(c3) of c3 is the maximal score (29) and so c3 is the winner rather than c2. However, to reach the true (or more probable) winner would have required more resources of the phones.

The setting of the parameters of the method described above is discussed later on.

In exemplary embodiments of the invention, rather than using voting by a range of preferences, other voting schemes may be used, such as Borda (as described above).

In exemplary embodiments of the invention, methods as described above may be combined in order to further save resources of the phones.

Alternative Voting

In exemplary embodiments of the invention, other methods for agreement on candidates are used, optionally with combination of the voting methods as described above. For example, mutual agreement or conforming to constraints of the peers. Optionally, one or more of the latter methods are used when the winner is important (e.g. an important meeting when it is mandatory that all the peers). Optionally, one or more of the latter methods is used, optionally partially, due to phones resources availability or time limitations.

In exemplary embodiments of the invention, the initiator requires that one or more candidates are considered as winners, even if they were not elected as such. For example, if a manager is required in a business meeting, than the time voted for by the manager, or optionally suggested by the manger, is mandatory. Optionally, failing to vote so that a mandatory candidate is agreed upon causes the voting to fail.

Privileged Peers and Preferences

In exemplary embodiments of the invention, the peers are considered equal and each one is given, at least approximately, an equal opportunity to vote, optionally at least as it is connected to the network.

In exemplary embodiments of the invention, one or more peers are privileged relative to other peers. Optionally, the privileged peers are given more opportunities (such as more iterations) to vote. Optionally or alternatively, the votes (preferences) of privileged peers are given larger weights relative to other peers. For example, when a range of votes is between 1 and 10 and a privileged peer voted with 7, the initiator sets the vote as 9. Optionally, the initiator enlarges a vote of a privileged peer beyond the maximal vote, such as 12 within a vote range of 1 and 10.

In exemplary embodiments of the invention, a peer is privileged by its social relations relative to others, for example, a parent relative to children in a family or a manager relative to workers in a plant.

In exemplary embodiments of the invention, peers may be divided to a plurality of sub-groups, each with its own privilege and, hence, different voting opportunities and/or preference weights.

In exemplary embodiments of the invention, peers are privileged according to the cost they bear in voting (e.g. transmission cost) and/or the load on their phones. Optionally, a peer is privileged according to inconvenience or difficulty it may have with respect to one or more candidates. For example, the peer is in vacation within suggested meeting date or is far away from some of the suggested meeting locations.

Peers, Phones and Agents

In exemplary embodiments of the invention, phones operate on the behalf of their peers.

In exemplary embodiments of the invention, the operation of the phones is carried out by computerized 'agents'.

In exemplary embodiments of the invention, an agent is implemented (coded), at least partially, as a program on a phone, such as phone 302 of FIG. 3, operating on behalf of its owner.

In exemplary embodiments of the invention, the agent comprises a software comprising one or more modules that use the memory and/or CPU and/or hardware and/or software of the phone. Optionally or alternatively, an add-on unit or units are used, comprising software and/or hardware, optionally with an extra CPU. Optionally, the software comprises existing and/or add-on firmware and/or computer-readable media. Optionally, the agent comprises other resources such as a server or facilities of the cellular network provider, or a server of the phone provider or manufacturer, or other devices or other peers.

In exemplary embodiments of the invention, the agent comprises data and facilities for management and/or control, such data buffering, sequencing of messages, tracking battery capacity, calculating communication time and/or costs and/or accessing a phone functions.

In exemplary embodiments of the invention, the agent may access facilities of a phone, such as a contacts directory or a battery voltage. Optionally, the agent may control and/or manage functions such as initiating and receiving calls or sending and/or receiving messages and/or data. Optionally, the access is coordinated with other activities of a phone such as voice communications. Optionally or alternatively, the agent access is, at least partially, independent of other activities of the phone, such as using different protocol and/or different band and/or different bus and/or different CPU (or CPU core).

In exemplary embodiments of the invention, the agent calculates and/or estimates costs of using a phone. Optionally or alternatively, the agent calculates and/or estimates costs of data transmissions activities such as sending votes. Optionally, costs are determined according to data size, available resources, payment program and/or geographical locations. Optionally, the agent may calculate and/or estimate revenues such as refunds due to usage of the service of a communications provider.

In exemplary embodiments of the invention, the agent may control and/or limit the usage of resource for voting. For example, limit the CPU time or bandwidth allocation for voting.

In exemplary embodiments of the invention, a phone obtains at least a part of the agent program and/or parameters from a server, for example, a server maintained by a cellular provider, a telephone manufacturer and/or a third party. Optionally, a phone obtains at least a part of the agent program and/or parameters from one or more other phones.

In exemplary embodiments of the invention, the agent operates, at least partly, on a server, for example, a server maintained by a cellular provider, a telephone manufacturer and/or a third party. Optionally, an agent for a phone operates on another phone, for example, with reference to FIG. 3, the agent of phone 302*a* operate, at least partially, on phone 302*b*.

In exemplary embodiments of the invention, the agent controls and/or maintains a tradeoff between the load on the initiator and/or peer phones and the confidence of the elected winner. Optionally, the agent controls or maintains the tradeoff according to rules coded the agent program. Optionally, the rules operate according to parameters that dictate priority and/or weights to saving resources (reducing load) and/or confidence of a winner.

In exemplary embodiments of the invention, the agent sets or maintains the privilege of a peer, and optionally, takes it into account in the tradeoff determination and/or rules. For example, a privileged voter may vote even beyond a resource limitation such as bandwidth. Privileges are further discussed later on.

In exemplary embodiments of the invention, the agent sets and/or maintains operational parameters of a voting method. For example, the contact numbers of voting peers, the maximal number of winners MW, the number of candidates $D_k$ the initiator requests in the group voting method, or the number of opted candidates nQ in the early elimination voting method. Optionally, the agent sets or determines the operational parameters according to the tradeoff described above.

In exemplary embodiments of the invention, the agent provides a user interface (UI). Optionally, the UI display entry fields to enter information about the peer. For example, the operational parameters above, or the preference of a candidate (vote), or tradeoff parameters such as preference or weight or limits of a load versus the confidence of winners.

In exemplary embodiments of the invention, other methods for setting parameters of the agent are used, for example, keypad codes or SMS messages sent to a server such as that of the service provider.

Peers Group

In exemplary embodiments of the invention, the voting is carried out within a group of peers.

In exemplary embodiments of the invention, the agent comprises code and/or parameters to manage the group members.

In exemplary embodiments of the invention, peers in a group are identified by an ID such as phone number, peer name, owner name or part of the owner name, or owner nickname or code or other unique identification. Optionally, in a cellular connection the SIM number may be used. Optionally, when the connection is TCP/IP, the ID is the IP number of a peer and/or optionally other ID such as MAC number or the peer device.

In exemplary embodiments of the invention, a group comprises, at least partially, predefined or preloaded numbers (or other ID), such as numbers of family members or work colleagues. For example, a phone owner may enter the phone number of members (or potential members). Optionally or alternatively, the numbers are loaded via a computer or server, optionally via a transmission. Optionally or alternatively, the numbers are loaded by a device such as USB storage device. Optionally, the service provider provides or loads the ID, e.g. according to registered persons charged with the same credit card. Optionally, the members ID are loaded from other service, such as that of the phones manufacturer.

In exemplary embodiments of the invention, the phone numbers (or other ID) stored in the phone directory (or as parameters of the agent) represent the at least a part of the group members. In such a manner, optionally, the group comprises the common (shared) numbers of the members phones (i.e. an intersection of directories numbers).

In exemplary embodiments of the invention, a group may be formed, at least partially, by contacting a service (e.g. cellular provider or a server of service of the manufacturer of the peer device) and registering itself in the service, optionally providing details such as peer name, peer phone number (or other ID such as IP or MAC number) and/or relations to other peers (e.g. family name, school name and/or class) or a privilege level. Optionally, the peer may provide details relating to known friends, or colleagues or others that the contacting peer determined to include in the group. For example, stating the additional peers relations to the peer (e.g. family relations, class mate, business name and/or title). Optionally, the peer registers other peers (e.g. family members or employees) in the service.

In exemplary embodiments of the invention, a peer privilege is preset or determined during voting or during optional other interactions of the peers. Optionally, a peer privilege is set according to hierarchy of a peer relative to other peers, such as a parent relative to a child, or a manager relative to a regular employee. For example, as a peer joins the group the peer is identified by the peer ID and a hierarchy, and privilege, is set relative to other peers. As another example, a peer hierarchy, or privilege, is raised based on the peer participation in voting or, possibly, other interactions. Optionally, the privilege of a peer is based on the costs of voting and/or loads on the resources of the peer, and may be granted higher privilege if the peer exceeds its resources budget (e.g. costs or battery capacity). Optionally or alternatively, the privileges of peers are agreed upon, for example, by a contacting each other, such as upon joining the network.

Optionally, a phone may contact the service (or server) and request the service (or server) to establish a contact with a peer (e.g. by stating the peer ID such as name). Optionally or alternatively, a phone may request the service to provide a phone number (or ID).

In exemplary embodiments of the invention, a peer in the group can contact another peer in the group by using the ID, for example, phone number or IP. Optionally, the ID is used to identify the contact method, for example, using a name to find the respective phone number. Optionally, a phone (or server or service) serves as a relay to other phones, for example, providing a contact number of another phone.

Exemplary Resources of Cellular Phones or Handsets

In exemplary embodiments of the invention, cellular phones are used as the peers.

Typically, cellular phones have limited resources. Following are typical numbers, which are expected to get better as technology improves (optionally paired with more demand on the peers such as data volume and transfer rate).

For example, memory is typically in range of a 16-128 KB of RAM and 1-50 MB for storable memory. Some phones allow optional additional memory cards to increases the capacity (e.g., 1-4 GB) but the access time is can be longer than the regular memory, so it may affect the performance and consumes more battery resources.

The processor in cellular phones is typically a low performance RISC or other architecture, designed to preserve the battery life on expense of performance.

In many telephones, very low resources are available during a telephone conversation or during a media capture operation, to carry out other tasks.

Battery life is typically about 6 to 24 hours in regularly used telephones.

The communication bandwidth is typically several hundreds of thousands of bits per second up to 1-3 millions of bits per second. For lower grade telephones, the transmission rate may be in the tens of thousands of bits per second. Also, significant delay times may exist.

The resources of cellular phones or handsets are expected to grow as technology progress. However, the load of activities such as for voting may grow accordingly, particularly, without limiting, as bandwidth is and battery lifetime (staying online) concerned.

General

In the description and claims of the present application, each of the verbs "comprise", "include" and "have" as well as any conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to necessarily limit the scope of the invention. In particular, numerical values may be higher or lower than ranges of numbers set forth above and still be within the scope of the invention. The described embodiments comprise different features, not all of which are required in all embodiments of the invention. Some embodiments of the invention utilize only some of the features or possible combinations of the features. Alternatively and additionally, portions of the invention described/depicted as a single unit may reside in two or more separate physical entities which act in concert to perform the described/depicted function. Alternatively and additionally, portions of the invention described/depicted as two or more separate physical entities may be integrated into a single physical entity to perform the described/depicted function. Variations of embodiments of the present invention that are described and embodiments of the present invention comprising different combinations of features noted in the described embodiments can be combined in all possible combinations including, but not limited to use of features described in the context of one embodiment in the context of any other embodiment. The scope of the invention is limited only by the following claims.

All publications and/or patents and/or product descriptions cited in this document are fully incorporated herein by reference to the same extent as if each had been individually incorporated herein by reference or if they were reproduced in full herein.

The invention claimed is:

1. A method for an iterative peer to peer voting by peers via mobile devices operating in a network on behalf of their owners, comprising:

a) requesting from a plurality of peers, via a plurality of peer-to-peer connections among a plurality of mobile devices, votes for a plurality of candidates provided by a first peer of said plurality of peers;

b) receiving votes for at least some of said plurality of candidates in a first mobile device of said plurality of mobile devices;

c) determining if more votes are needed; and d) based on said determining either repeating steps a) to c) or determining at least one winner of said plurality of candidates, according to the votes.

2. A method according to claim 1, wherein requesting is from the first peer.

3. A method according to claim 1, wherein the first peer defines the candidates.

4. A method according to claim 1, wherein requesting comprises requesting a part of the votes of the plurality of peers.

5. A method according to claim 1, wherein said determining at least one winner comprises determining based on partial votes.

6. A method according to claim 1, wherein said determining at least one winner comprises determining according to estimation of missing votes.

7. A method according to claim 6, wherein the estimation comprise estimation of maximal and minimal votes based on preferences of candidates.

8. A method according to claim 1, wherein determining comprises said determining at least one winner according to modified votes.

9. A method according to claim 8, wherein the votes are modified according to a privilege of at least one of said plurality of peers.

10. A method according to claim 1, wherein the plurality of peers comprise peers joining the network during the in voting and at least partially participating the voting.

11. A method according to claim 1, wherein the plurality of peers comprise peers that at least partially participate in the voting and leave the network during the voting.

12. A method according to claim 1, wherein requesting votes comprises requesting a group of candidates with a common vote.

13. A method according to claim 1, wherein requesting votes comprises requesting votes of candidates according to candidates already sent in a previous iteration.

14. A method according to claim 1, wherein the number of iterations is limited.

15. A method according to claim 1, wherein said determining at least one winner is according to a compromise between a confidence of a winner and usage of the resources of the devices.

16. A method according to claim 15, wherein resources comprise at least one of bandwidth, energy, memory or operation costs.

17. A method according to claim 1, wherein the plurality of mobile devices comprise wireless devices.

18. A method according to claim 1, wherein the plurality of mobile devices comprise cellular devices.

19. A method according to claim 1, wherein each of the plurality of mobile devices operate on behalf of an owner, at least partially, by computerized agents.

20. A method according to claim 1, wherein the plurality of candidates comprise discrete objects.

21. A method according to claim 1, wherein the plurality of candidates comprise ranges within an extent of a continuous entity.

22. A method according to claim 1, wherein the candidates comprise at least one of meeting times, meeting locations, or apparatus, articles, agendas, positions and persons.

23. A system comprising computerized mobile devices configured to perform the method of claim 1.

24. A method according to claim 1, wherein requests for the more votes relate to candidates included in a set of possible winners.

25. A method according to claim 24, further comprising estimating maximal and minimal votes for missing candidates, wherein the set of possible winners comprises candidates with maximal score that is larger or equal to the minimal scores of any of the other candidates.

26. A method for iteratively voting by peers via mobile devices operating in a network on behalf of their owners, comprising:

(a) providing a plurality of peers with a plurality of phones operating on behalf of the peers;

(b) requesting from at least one peer from a plurality of peer to peer connections among said plurality of phones to vote for a winner with a confidence equal or less than that of constraints satisfaction;

(c) receiving in one of said plurality of phones said vote;

(d) determining if further votes are needed; and (e) based on said determining either repeating steps (b) to (d) or determining said winner according to the confidence votes.

27. A method according to claim 26, wherein the plurality of peers comprises peers at least partially participating in the voting, that join or leave the network during the voting.

28. A method according to claim 26, wherein the winner is a meeting time.

29. A method according to claim 26, wherein requesting comprises in each iteration requesting from another peer.

* * * * *